US005234400A

United States Patent [19]

Kluge

[11] Patent Number: 5,234,400

[45] Date of Patent: Aug. 10, 1993

[54] METHOD AND APPARATUS FOR THE SEPARATION, PARTICULARLY CLASSIFICATION OF A SOLIDS/LIQUID MIXTURE

[75] Inventor: Reinhard Kluge, Bergisch Gladbach, Fed. Rep. of Germany

[73] Assignee: Kloeckner-Humboldt-Deutz AG, Fed. Rep. of Germany

[21] Appl. No.: 881,432

[22] Filed: May 11, 1992

[30] Foreign Application Priority Data

May 10, 1991 [DE] Fed. Rep. of Germany ..... 4115347

[51] Int. Cl.[5] ..... B04B 1/20

[52] U.S. Cl. ..... 494/54; 494/53

[58] Field of Search ..... 494/53, 54, 52, 50, 494/51, 56, 43; 210/380.1, 380.3

[56] References Cited

U.S. PATENT DOCUMENTS

| | | | |
|---|---|---|---|
| 3,782,623 | 1/1974 | Bye-Jorgensen et al. | 494/53 |
| 4,298,159 | 11/1981 | Epper et al. | 494/53 |
| 4,362,620 | 12/1982 | High | 210/380.3 |
| 4,517,092 | 5/1985 | Stahl | 494/53 |
| 4,790,806 | 12/1988 | High | 494/53 |
| 4,826,608 | 5/1989 | Kopper | 494/54 |
| 4,828,541 | 5/1989 | Madsen | 494/53 |

FOREIGN PATENT DOCUMENTS 3620912 12/1987 Fed. Rep. of Germany .

*Primary Examiner*—Harvey C. Hornsby
*Assistant Examiner*—Reginald L. Alexander
*Attorney, Agent, or Firm*—Steadman & Simpson Hill

[57] ABSTRACT

A method and an apparatus for centrifugally separating and classifying a liquid slurry into a solids heavy phase and a light phase fraction with a rotary mounted centrifugal drum having a cylindrical section extending from a first end and completed by a conical section extending toward a second end, a rotary auger within the drum moving slurry from the first to the second end, a slurry inlet at the first end; outlet nozzles extending at an oblique angle opposite the rotational direction of the drum in the cylindrical section for discharge of the heavy phase material, and light phase openings at the second end in the conical section close to the drum axis.

9 Claims, 1 Drawing Sheet

METHOD AND APPARATUS FOR THE SEPARATION, PARTICULARLY CLASSIFICATION OF A SOLIDS/LIQUID MIXTURE

BACKGROUND OF THE INVENTION

The invention relates to improvements in methods and apparatus for the separation and classification of a solids liquid slurry by a centrifugal separator which centrifugally separates the slurry into a light phase fraction and a heavy phase fraction.

In German Published Application 36 20 912, there is disclosed a solid bowl worm centrifuge for separating solids and liquid mixtures whereby the mixture within the drum is moved in one direction by a worm within the conveyor in co-current flow. The liquid is separated from the solids under influence of the centrifugal force. The liquid separated from the solids within the drum is subsequently accepted by channels arranged uniformly distributed over the circumference at the worm member and is discharged to the outside via discharge openings at one end. With the solids liquid mixture moving from left to right in a co-current flow within the drum, the liquids are discharged at the left hand side whereas the solids are discharged at the right hand side via nozzles which are uniformly distributed over the circumference at the right hand side of the centrifuge drum.

The liquids separated from the solids, with said liquids representing the light phase, are deflected by 180° within the centrifuge drum in the proximity of the thick matter discharge and said liquid is transported through the drum discharged toward the outside through the channels arranged at the worm member and in a direction opposite that of the solids. Due to the substantial deflection of the light phase in the discharge region of the heavy phase, turbulences occur that do not favor a clear separation or classification of the solids liquid mixture and such turbulences are unavoidable in the region of the drum.

U.S. Pat. No. 3,782,623 discloses a solid bowl worm centrifuge for separating a solids liquid mixture. In that disclosure, the solid liquids mixture in the drum is essentially conducted in a co-current flow and the phases which are separated from another are discharged from the drum at the side lying opposite the material input side. In this disclosure, the light phase is deflected radially inwardly into the hollow shaft of the worm with the assistance of a curved pipe and is discharged to the outside through the hollow shaft of the worm. Turbulences within the centrifugal drum in this region are also unavoidable and do not favor enabling a clear separation particularly where a good separation or classification of the solids liquid mixture must occur. The same problem is true for known trailing blade centrifuges wherein the heavy phase in the centrifuge drum is radially inwardly accepted into the hollow shaft of the worm and is discharged toward the outside through this hollow shaft.

An object of the present invention is to provide an improved method and apparatus for the centrifugal separation and classification of a solids liquid mixture in a solid bowl worm centrifuge which avoids the disadvantages of arrangements heretofore available in the prior art.

A further object of the invention is to provide an improved solid bowl centrifugal separator wherein the slurry being separated moves coaxially from a first entry end toward a second entry end and separation occurs without the resulting distracting turbulence which occurs in devices heretofore available.

A still further object of the invention is to provide an improved centrifugal separator wherein separation occurs with a mechanism of an improved simplified structure to effect improved separation and improved throughput for equipment of a given size.

FEATURES OF THE INVENTION

The objects of the invention are served and the difficulties of the prior art avoided in an arrangement wherein both the light phase as well as the heavy phase are conducted in concurrent flow through a centrifuge drum up to their discharge at an end lying opposite the material input end. As material enters a first end of a centrifugal separator, it separates during travel through the length of the separator and both the heavy fraction and light fraction are discharged toward the second end of the separator. The separator is constructed of a cylindrical section which extends from the first end toward the second end and continues in a conical section to the second end. The discharge of the heavy phase occurs through nozzle shaped openings in the cylindrical section of the shell at the second end thereof. The light phase material is discharged through openings which are closer toward the axis of the separator which are also located at the second end of the separator although further toward the second end than the heavy phase openings.

As a result of the arrangement provided, no turbulences are produced within the drum that could potentially disturb the separating process. Both phases are separated and conducted in concurrent flow through the drum without deflection up to the discharge location and completely without disturbance.

Further, the overall drum length is utilized in the practice of the method of the invention so that not only the dewatering effect is significantly improved in the separation of the solids liquid mixture, but a classification and in particular a fine grained classification is advantageously achieved. The centrifuge can be effectively utilized for both the separating function wherein a solids liquid mixture is separated as well as a classification unit wherein classification of particle size within the slurry must be achieved.

Other objects, advantages and features will become more apparent with the teaching of the principles of the invention in connection with the disclosure of the preferred embodiments thereof in the specification, claims and drawings, in which:

DESCRIPTION OF THE PREFERRED EMBODIMENTS

Figure 1:
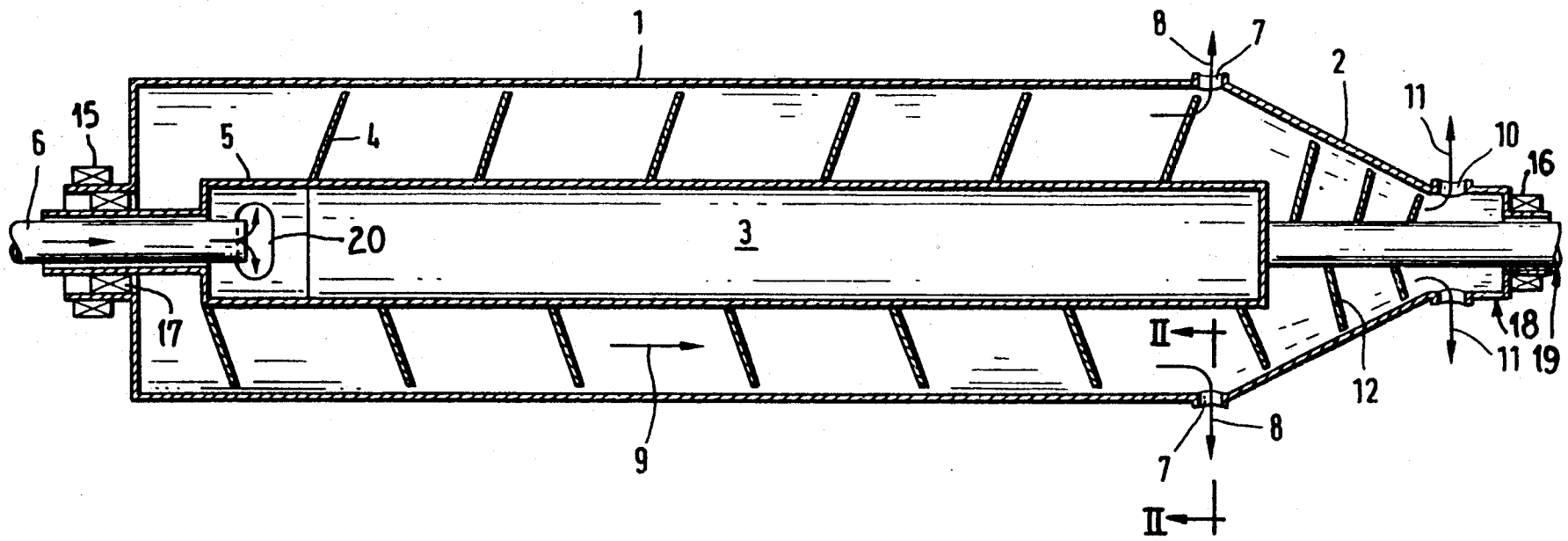
FIG. 1 of the drawing is a sectional view shown somewhat schematic in form of a section taken through the axis of a centrifugal drum employing the principles of the present invention.

The drawings illustrate a solid bowl worm centrifuge including a rotationally mounted solid cylindrical basket shell or drum 1. The drum has a relatively long cylindrical section extending from a first end at the left hand side of FIG. 1 toward the second end of the drum separator. At the second end, the cylindrical section continues as a conical section 2. Within the drum extending coaxially through both the cylindrical section and the conical section is a conveyor worm 3. The drum is suitably supported for rotation on its axis on bearings 15 and 16. The conveyor worm is supported on a central hollow shaft 5 supported on separate bearings 17 shown at one end and omitted for the sake of clarity at the other end.

The drum has a separate suitable drive shown schematically at 18 and the conveyor worm is independently driven by means shown schematically at 19. On the hollow shaft 5 is a worm helix 4. The conveyor worm is constructed so that a slurry admission conduit 6 leads coaxially into the first end of the drum discharging into the hollow shaft and the slurry flows out through openings 20 of the hollow shaft into the space between the conveyor worm and the shell of the drum 1.

The slurry is carried in concurrent flow from the first end at the left side of the drawing of FIG. 1 toward the right end and centrifugal separation occurs during the concurrent flow in the direction indicated by the arrowed line 9.

As centrifugal separation occurs with rotation of the drum 1, and the material is advanced in the direction of the arrowed line by the conveyor worm 3, the heavy phase fraction is separated from the slurry and is discharged through discharge nozzles 7 which are located at the second end of the cylindrical section of the drum. While two discharge openings are illustrated, additional nozzles are provided uniformly distributed over the circumference of the drum. These nozzles are located at the second end of the cylindrical section or in other words, at the transition region where the cylindrical section joins the conical section.

The heavy phase is discharged through these nozzles 7 during operation of the centrifuge as indicated by the flow arrows 8.

The light phase fraction is discharged from the drum through discharge openings 10 which are arranged at the second end at the far right side of the drawing of FIG. 1. These light phase openings are similarly uniformly distributed over the circumference at the second end of the drum at the end of the conical section 2. As will be observed from the drawings, the light phase openings 10 are located radially inwardly relative to the axis of the drum or in other words, close to the conveyor worm shaft. The heavy phase openings 7 are further from the axis than the light phase openings. Also, the heavy phase openings 7 are arranged in advance of the light phase openings relative to the direction of the concurrent flow of the slurry or in other words, the light phase openings 10 are closer to the second end of the drum than the heavy phase openings 7.

In the discharge of the light phase or liquid phase of the material, as indicated by the flow arrows 11, the light phase emerges a distance following the heavy phase which flows out in the direction of the flow arrows 8. The separating effect and particularly the classifying effect on the slurry or the solids liquid mixture is advantageously influenced by this arrangement. To further the effect of the foregoing arrangement, the worm helix is arranged with different pitches so that the portion 4 of the worm within the cylindrical section has a greater pitch than the pitch of the lights 12 within the conical section. As a result of this design of the worm helix with less of a pitch within the conical portion carrying the light phase material to the openings 10, a disturbance free discharge of the light phase from the drum is guaranteed. As an alternative construction, the worm helix 12 in the region of the conical section may also be designed with a pitch directed opposite that of the worm section 4 in order to further promote the discharge of the light phase.

The desired separation or cut of the grain spectrum present in the slurry mixture can be advantageously influenced in this manner and the separating cut can be displaced as needed namely by providing a variation of discharge openings arranged in varying cross-sections or numbers which are provided. Further, an upward or a downward shift of the granulation or separating cut with the centrifuge of the present invention can be accomplished. In a preferred arrangement, the cylindrical section of the drum is of a length relative to the conical section that is in the ration of 4. That is, the cylindrical section will be 4 times longer than the conical section in the axial direction. Effects can also be achieved in a simple way in the variation of the differential speed between the centrifugal drum and the conveyor worm. Also, further control can be obtained by a variation of the discharge opening 10 in terms of their number or in terms of their cross-sectional size. For this purpose, the openings 7 can be arranged as nozzles which are replaceable and nozzles of different sizes can be positioned into the openings 7 to provide for a different total cross sectional openings available to the discharge of the heavy fraction.

Figure 2:
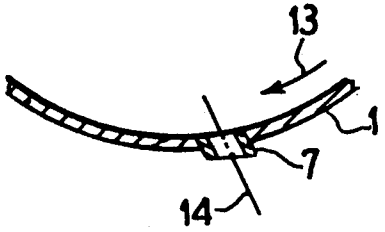
FIG. 2 is an enlarged fragmentary sectional view taken substantially along line II—II of FIG. 1.

In a preferred arrangement, the nozzles 7 are set at an angle. The nozzles are arranged to lie in a plane transverse of the axis of the drum and extend obliquely or tangentially relative to the rotational direction of the drum and preferably in a direction opposite the rotational direction. As shown in FIG. 2, with the drum rotating in a direction indicated by the arrowed line 13, the axis 14 of the nozzle openings will be at a trailing angle relative to the drum rotation.

An important factor of the invention to achieve a sharply fine separation or thickening or classification of the solid liquid slurry mixture, without requiring the provision of a sieve, is to obtain the co-current flow through the centrifuge over a relatively long distance from the first entry end of the drum to the second discharge end. The discharge of the heavy phase through the nozzle shaped openings 7 occurs at a greater radius or further toward the outside than the discharge of the light phase openings 10 which are in the proximity of the worm drive shaft 5. As a result of this arrangement, a completely disturbance free settling or separation process of the solids from the slurry extends over the length of the centrifuge drum and is accomplished.

As an alternative to the specific arrangement of the solid bowl worm centrifuge illustrated in the drawings, a centrifuge designed smaller and larger in terms of diameter and length ratio can be utilized for implementing the method with the advantages of the invention. In some forms, the features of the invention may be utilized with a drum which is fully cylindrical in shape rather than the combined cylinder conical shaped drum. In an arrangement where a full cylinder is utilized, the discharge openings for the light phase are arranged in the proximity of the worm shaft at the end wall lying on the second end opposite the material inlet at the first end. Further, it may be expedient to adjust the arrangement of the nozzle shaped discharge opening for the heavy phase into the beginning region of the conical section. The nozzle shaped discharge openings for the heavy phase may be arranged earlier relative to the flow of material so that no deflection or turbulence occurs upon the discharge of the heavy phase from the drum.

Thus, it will be seen that there have been provided an improved method and apparatus for centrifugal separation which meets the objectives and advantages above set forth and provides for an improved separation and classification of materials.

I claim as may invention:

1. A method of classification separation of a liquid slurry into a solids heavy phase fraction and a liquid fraction comprising the steps:

directing a flow of slurry containing particulate material to be separated into a cylindrical rotary centrifugal separator drum with light phase material and heavy phase material guided through the drum and in co-current flow;

flowing the slurry axially through the drum form a first end and to a second opposite end;

moving the slurry axially from the first to the second end by an independently rotatable auger mounted on a coaxially located drive shaft;

withdrawing a heavy phase fraction of the slurry at the circumference of the drum adjacent said second end of the drum at the largest diameter of the drum;

and withdrawing a light phase fraction form said second end at a location after the heavy phase withdrawal in the direction of current flow, said light phase being conveyed to a light fraction opening at a location adjacent the auger shaft, by the auger.

2. A method of classification separation of a liquid slurry into a solids heavy phase fraction and a liquid fraction in accordance with the steps of claim 1:

wherein the heavy phase fraction is withdrawn axially a distance in advance of the light phase fraction relative to the flow of the slurry form the first to the second end.

3. A centrifugal separator for classification separation of a liquid slurry into a solids heavy phase fraction and a liquid light phase fraction comprising in combination:

a rotary mounted centrifugal separation drum having a liquid slurry inlet at a first end and extending to a second end;

the drum having a cylindrically shaped section and a conically shaped section progressing from the cylindrical section to the second end;

an independently rotatable auger mounted coaxially within the drum having flights for moving the slurry from the first end to the second end of the drum;

heavy phase fraction discharge openings in said cylindrical section adjacent said second end;

and light phase fraction discharge openings in said conical extension at the second end of the drum.

4. A centrifugal separator for classification separation of a liquid slurry into a solids heavy phase fraction and a liquid light phase fraction constructed in accordance with claim 3:

wherein the ratio of the length of the drum to the drum diameter is substantially 4 to 1.

5. A centrifugal separator for classification separation of a liquid slurry into a solids heavy phase fraction and a liquid light phase fraction constructed in accordance with claim 3:

wherein said auger is provided with a first pitch within the cylindrical section and a second pitch within the conical section with the second pitch being less than said first pitch.

6. A centrifugal separator for classification separation of a liquid slurry into a solids heavy phase fraction and a liquid light phase fraction constructed in accordance with claim 3:

wherein said heavy phase openings are nozzle shaped spaced circumferentially around the drum.

7. A centrifugal separator for classification separation of a liquid slurry into a solids heavy phase fraction and a liquid light phase fraction constructed in accordance with claim 6:

wherein said nozzle shaped openings are angled in a diametral plane extending at right angles to the axis of the drum and said angle extends obliquely tangentially outwardly opposite the rotational direction of the drum and wherein said drum has a predetermined rotational direction.

8. A centrifugal separator for classification separation of a liquid slurry into a solids heavy phase fraction and a liquid light phase fraction comprising in combination:

a rotary mounted centrifugal separation drum mounted for rotation and having a first drive means for driving the drum in rotation at a predetermined rotational speed;

an auger within the drum mounted coaxially therein having a hollow center supporting shaft with auger flights on the center shaft leading from a first end to a second end of the drum;

a second independent drive for the auger;

a coaxial inlet conduit at said first end leading into the hollow shaft;

means defining radially outwardly extending openings for slurry passing through the inlet to flow into the spaces occupied by the auger flights;

said drum having a first cylindrical section progressing from the first end and being of uniform diameter extending toward the second end, said drum having a conical extension progressing from the cylindrical portion and extending to the second end;

said auger having flights supported on the hollow shaft with a first pitch and having second flights extending into the conical section of a second pitch being less than the first pitch with the flights arranged to move slurry within the drum from the first toward the second end;

a plurality of heavy phase outlet discharge nozzles at a second end of the cylindrical section of the drum lying in a plane transverse of the drum axis and angled in said plane to extend obliquely outwardly in a direction opposite the rotational direction of the drum;

and light phase openings in the second end of the conical section positioned adjacent the auger shaft and spaced radially inwardly from the heavy phase openings.

9. A centrifugal separator for classification separation of a liquid slurry into a solids heavy phase fraction and a light phase fraction comprising in combination:

a rotary mounted centrifugal separation drum having a liquid slurry inlet at a first end extending coaxially with an axis of rotation of the drum;

said drum having a cylindrical section extending from a first end for the major length of the drum toward a second end and having a conical extension progressing from the cylindrical section to the second end of the drum;

an auger mounted within the drum for moving the slurry therein from the first end toward the second end, said auger having flights with a first pitch within the cylindrical section and a second pitch within the conical section and the second pitch being less than the first;

heavy material discharge outlets in the cylindrical section of the drum at the second end;

and light phase fraction openings at the second end leading from the conical section of the drum at a radius closer to the auger shaft than the heavy phase openings.

* * * * *